US005149030A

United States Patent [19]

Cockrill

[11] Patent Number: 5,149,030

[45] Date of Patent: Sep. 22, 1992

[54] ADVANCED NEONATAL TRANSPORT SYSTEM

[75] Inventor: Todd G. Cockrill, Little Rock, Ark.

[73] Assignee: Summa A.N.T.S., Little Rock, Ark.

[21] Appl. No.: 288,966

[22] Filed: Dec. 23, 1988

[51] Int. Cl.[5] ..... A61G 12/00

[52] U.S. Cl. ..... 248/129; 280/79.11

[58] Field of Search ..... 248/647, 678, 129; 280/79.4, 32.6; 296/70; 5/89, 82

[56] References Cited

U.S. PATENT DOCUMENTS

| | | | |
|---|---|---|---|
| 1,785,064 | 12/1930 | Tendler | 280/79.11 X |
| 1,823,526 | 9/1931 | Breeden | 280/32.6 |
| 2,689,748 | 9/1954 | Savery | 280/79.11 X |
| 3,303,056 | 1/1967 | Kaspar | 211/134 |
| 3,907,117 | 9/1975 | Williams | 248/129 X |

FOREIGN PATENT DOCUMENTS

| | | | |
|---|---|---|---|
| 121075 | 10/1984 | European Pat. Off. | 280/79.11 |
| 219274 | 4/1987 | European Pat. Off. | 248/129 |
| 3534794 | 4/1987 | Fed. Rep. of Germany | 280/79.11 |
| 1497108 | 10/1967 | France | 280/79.11 |

*Primary Examiner*—Alvin C. Chin-Shue

*Attorney, Agent, or Firm*—Fleit, Jacobson, Cohn, Price, Holman & Stern

[57] ABSTRACT

A uniquely constructed stretcher or sled provided with mounting hardware to support existing medical equipment in a compact and effective manner thereby providing an extremely effective neonatal emergency transport system. The stretcher includes mounting hardware at the central portion thereof for a transport incubator and attached to the incubator is a bracket specifically constructed to mount a heated humidifier. Adjacent the incubator unit toward the right end of the stretcher is a rack system of brackets to consolidate and support several pieces of equipment used in monitoring the neonate and the environment inside the incubator including an infusion pump, oxygen monitor, pulse oximeter and ECG monitor. At the other end of the stretcher, an aircraft approved battery system is mounted on bracket structure along with a power switching device to provide capability of using standard AC power for standby operation prior to transfer to the helicopter with the power switching arrangement enabling the power source to switch between AC and DC power on demand as needed.

7 Claims, 1 Drawing Sheet

ADVANCED NEONATAL TRANSPORT SYSTEM

BACKGROUND OF THE INVENTION

Field of the Invention

The present invention generally relates to a medical transport unit specifically useful in emergency neonatal transport in helicopters, other aircraft and vehicles. More specifically, the present invention relates to a uniquely constructed stretcher or sled provided with mounting hardware to support existing medical equipment in a compact and effective manner thereby providing an extremely effective neonatal emergency transport system. The stretcher includes mounting hardware at the central portion thereof for a transport incubator and attached to the incubator is a bracket specifically constructed to mount a heated humidifier. Adjacent the incubator unit toward the right end of the stretcher is a rack system of brackets to consolidate and support several pieces of equipment used in monitoring the neonate and the environment inside the incubator including an infusion pump, oxygen monitor, pulse oximeter and ECG monitor. At the other end of the stretcher, an aircraft approved battery system is mounted on bracket structure along with a power switching device to provide capability of using standard AC power for standby operation prior to transfer to the helicopter with the power switching arrangement enabling the power source to switch between AC and DC power on demand as needed.

INFORMATION DISCLOSURE STATEMENT

The transportation of newborn infants (neonates) presents particular problems since it is necessary to maintain the neonate in a controlled environment in an incubator and to monitor and control various conditions during all phases of the trip. When the neonatal transport includes the use of various types of vehicles and power sources, it is necessary to provide a power source that is not dependent upon connection to a vehicle or other external power source. While various medical components are available, they are difficult to arrange and maintain in proper operative and effective position during various phases of a neonatal transport especially under emergency conditions in a helicopter, other aircraft or vehicle. While stretchers, gurneys and other types of carts for various equipment are well-known, none of the prior art provides a neonatal transport system utilizing a stretcher having a rigid structure and bracket assemblies for effectively supporting and mounting existing medical equipment in a manner to form an extremely effective neonatal emergency transport system.

SUMMARY OF THE INVENTION

An object of the present invention is to provide an advanced neonatal transport system which is a stretcher based system incorporating a stretcher covered with sheet metal and fitted with mounting brackets and hardware to support various existing medical equipment in optimum position thereby forming an extremely effective neonatal emergency transport system especially adapted for use in emergency helicopter transport of neonates.

Another object of the invention is to provide a neonatal transport system in accordance with the preceding object in which the central portion of the stretcher is provided with a bracket structure specifically adapted to mount and support an existing incubator with bracket structure being attached to the incubator specifically adapted to secure the mounting assembly for a heated humidifier in order to support the incubator and humidifier securely in optimum position in relation to each other and in relation to the central portion of the stretcher thereby enabling the stretcher to be transported along with the incubator and the central portion thereof with the least possible movement of the neonate in the incubator.

A further object of the invention is to provide a neonatal transport system in accordance with the preceding objects having a rack system of brackets mounted on the right end of the stretcher adjacent the incubator to support and consolidate several pieces of medical equipment used in monitoring the neonate and the environment inside the incubator.

Still another object of the invention is to provide a neonatal transport system in which the opposite (left) end of the stretcher includes an aircraft approved battery system mounted thereon and associated charging circuit, indicator light and power switching arrangement to switch between AC power and DC battery power on demand as needed with all of these components being arranged in optimum position in relation to each other and in relation to the stretcher so that the stretcher has substantially equal weight characteristics at each end thereof with the stretcher including open areas to provide hand access to the peripheral rail to facilitate transport of the stretcher with the stretcher also including wheels or casters to enable it to be rolled along a supporting surface when desired with the neonatal transport system enabling transport of an infant or neonate without adverse influences under emergency conditions in a helicopter or other aircraft or in various types of vehicles with the stretcher and associated equipment and brackets being substantially rigid and effective for positively securing the medical equipment in place and maintaining all of the medical components and the neonate in a secure position for safe transport of the neonate.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
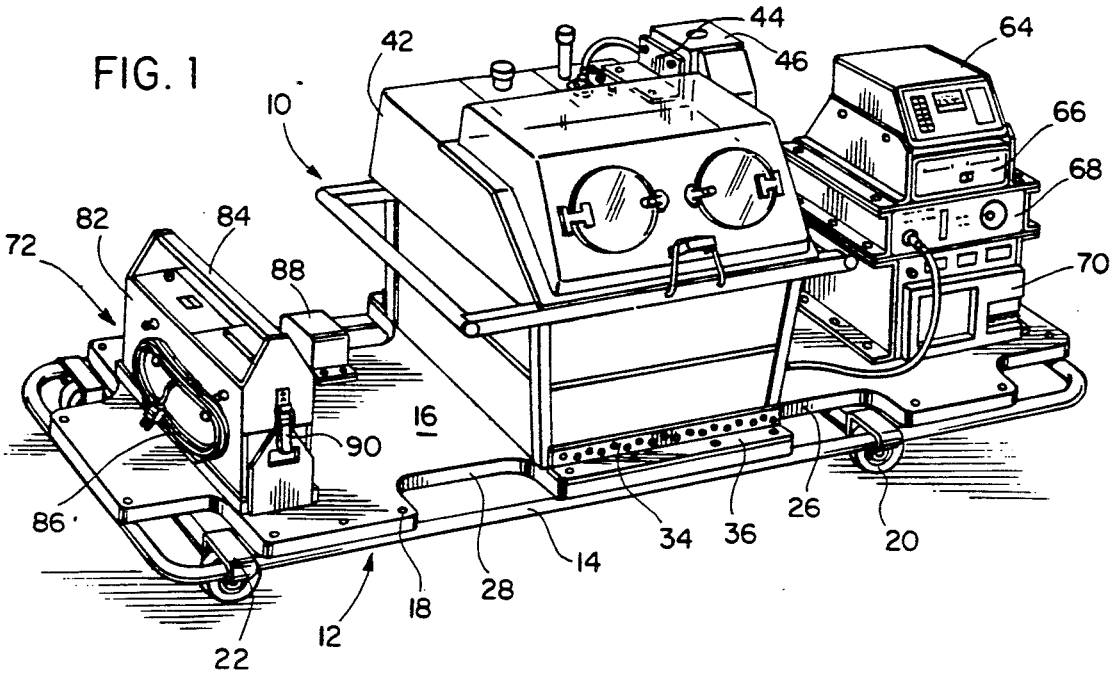
FIG. 1 is a perspective view of the advanced neonatal transport system of the present invention illustrating the medical equipment mounted on the stretcher.

Referring now specifically to the drawings, the neonatal transport system of the present invention is generally designated by reference numeral 10 and includes a stretcher generally designated by the numeral 12 as the basic unit of the invention. The stretcher 12 includes a rigid peripheral frame 14 of rectangular configuration which is constructed of a tubular member or rail such as aluminum pipe or tubing of rigid construction. The stretcher unit may be constructed as a modified collapsible stretcher in which the frame 14 is provided with a rigid panel 16 in the form of a rigid aluminum sheet having a thickness of approximately ½" secured to the frame 14 by fastening bolts 18 or other equivalent fastening arrangements in order to provide a rigid stretcher. The stretcher is supported by a plurality of rollers or wheels 20 adjacent the corners of the frame which are supported by bracket structures 22 and axle assemblies 24 with the bracket assemblies 22, in effect, wrapping around the rail of the frame 14 with the wheels or rollers 20 being rotatable about axes transverse to the stretcher 12 and, if desired, one of the pairs of rollers may be caster rollers or wheels if desired. The aluminum sheet panel 16 is provided with notches or cut-outs 26 and 28 on the side edge portions thereof and at the corners 30 and 32 to provide access to the frame rail 14 to enable the stretcher 12 to be easily lifted and handled in a conventional and well-known manner.

Between the notches 26 and 28, the panel 16 is provided with a pair of upwardly extending brackets 34 having a lower outwardly extending flange 36 secured to the panel 16 by fasteners 38 with the upwardly extending, elongated brackets 34 including a plurality of apertures 40 for supporting and anchoring an incubator 42 thereon with fasteners extending through certain of the apertures 40 to rigidly and detachably secure the incubator 42 in place. The incubator 42 is an existing piece of medical equipment such as the Vickers 77 Transport Incubator, MK-3 manufactured by Vickers Medical Company of England and distributed in the United States by Air Shields Incorporated. At the upper right hand corner of the incubator 42, a special bracket structure 44 is attached thereto for supporting a humidifier 46 alongside the incubator 42. The humidifier is a Concha-Therma III heated humidifier manufactured by Respiratory Care Incorporated.

Figure 2:
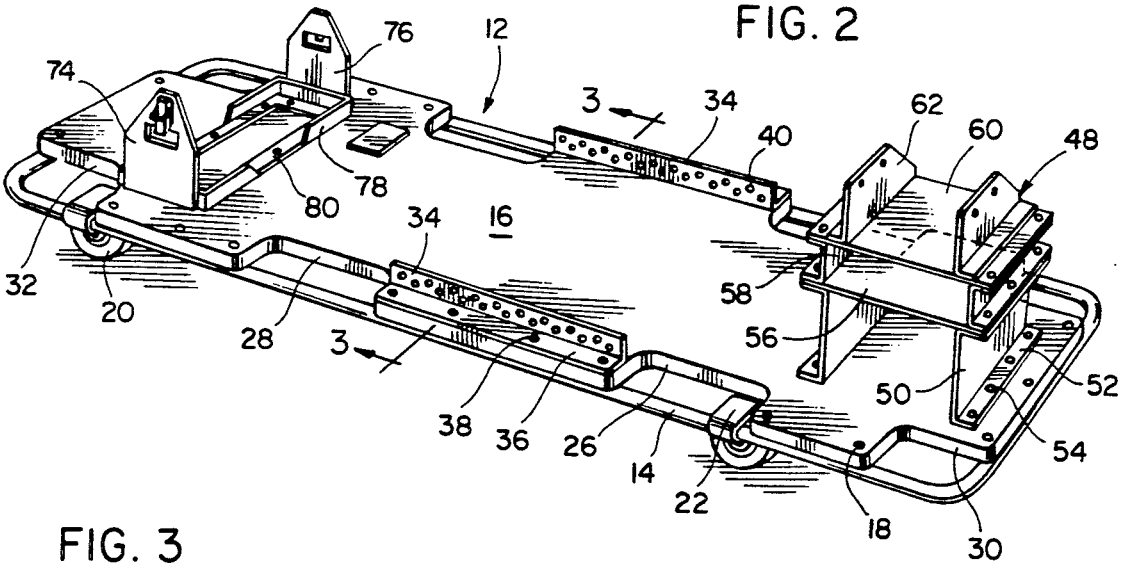
FIG. 2 is a perspective view of the stretcher illustrating the mounting brackets for the medical equipment.
Figure 3:
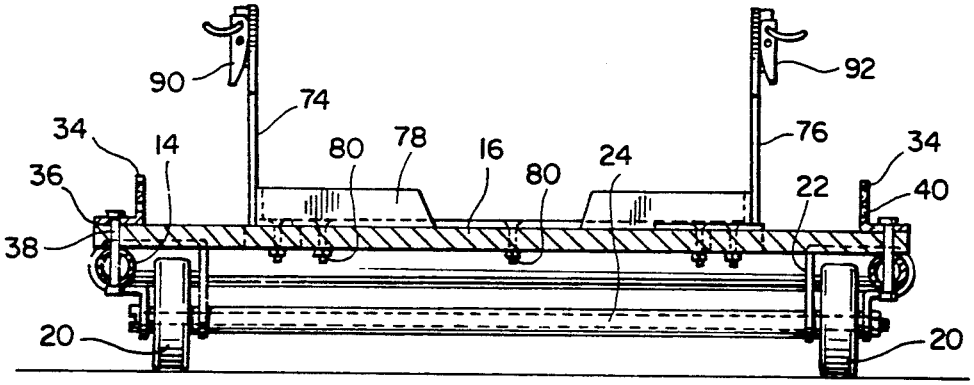
FIG. 3 is a transverse, sectional view taken substantially upon a plane passing along section 3—3 on FIG. 2 illustrating structural details of the stretcher.

Adjacent the incubator 42 and the incubator brackets 34, adjacent the right end of the stretcher as observed in FIG. 2, there is a rack system of brackets 48 including a pair of upstanding brackets 50 with outwardly extending bottom flanges 52 secured to the panel 16 by fasteners 54. At the upper end of the brackets 50, a shelf unit 56 is supported with upstanding brackets 58 at the outer edges thereof which support an upper shelf unit 60 which includes upstanding brackets 62 at the outer edges thereof for supporting an infusion pump 64, oxygen monitor 66, pulse oximeter 68 and an ECG monitor 70, respectively, all of which are existing equipment with the infusion pump being a Medfusion Model 1001 manufactured by Medfusion Systems Incorporated. The oxygen monitor 66 is a Hudson Model 5590 manufactured by Hudson Ventronics Incorporated. The pulse oximeter 68 is a Nellcor Model N200 manufactured by Nellcor Incorporated and the neonatal ECG monitor 70 is a Tektronix Infant Monitor manufactured by Tektronix Incorporated.

Adjacent the opposite end of the stretcher, the left end as observed in FIG. 2, a battery system approved for aircraft use generally designated by numeral 72 is supported by upstanding end brackets 74 and 76 together with a peripheral frame bracket-78 interconnecting the upstanding end brackets 74 and 76 and being secured to the panel 16 by fastening devices 80. The battery system 72 includes nickel-cadmium battery pack units 82 in a battery box provided with a carrying handle 84 and a power cord 86 is provided for connection to an alternate power source such as a standard AC power source. The battery system 72 is approved for aircraft use and includes a charging circuit and an indicating light system for full charge, power on. The power switching between AC and DC power on demand as needed is accomplished by the use of a power switching device 88 mounted on the panel 16 adjacent the battery system and is a Potter Brumfield 25 amp. contactor which switches between AC and DC on demand as needed and is located adjacent to and between the battery box and the incubator 42. The batteries, battery box and carrying assembly 82 and 84 are connected to the upstanding end brackets 74 and 76 by latch devices such as over-center latches 90 and 92 to enable replacement of the batteries when desired or necessary.

The bracket structures maintain the incubator, humidifier, infusion pump, oxygen monitor, pulse oximeter, neonatal monitor, battery assembly, alternate power source and power switch in secure and optimum relationship for forming an effective neonatal transport system with the stretcher unit providing a rigid base for the bracket structures and medical equipment mounted thereon with the stretcher unit being provided with handles along the sides and at the corners thereof to enable grasping of the rail in order to lift and handle the assembly in an effective manner with the wheels enabling rolling support of the assembly on a supporting surface with the device including the capability of being powered by AC or DC with the power switch being capable of switching from one power source to the other as may be required.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. A neonatal transport system comprising a stretcher having a rigid panel having a large, substantially planar upper surface and peripheral handle forming means to enable the stretcher to be carried, a plurality of bracket structures mounted on the rigid panel, equipment supported by said bracket structures in optimum relationship and in secure relationship from the upper surface of the panel with the supported medical equipment including an incubator for a neonate located centrally of the stretcher, a humidifier supported from the incubator, an infusion pump, oxygen monitor, pulse oximeter, neonatal ECG monitor mounted adjacent one end of the stretcher and alternative AC cord and DC battery system with power switch for supplying AC or DC power on demand mounted adjacent the other end of the stretcher.

2. The system as defined in claim 1 wherein said handle forming means includes a peripheral frame rail of generally rectangular configuration, said panel having a similar configuration and being a rigid, lightweight metal panel secured to the frame rail with the panel including a plurality of peripheral notches at the corners and at the central portions of the frame rail to form handles for handling the system.

3. The system as defined in claim 2 together with supporting wheels mounted on the stretcher for rolling engagement with a supporting surface to enable rolling movement of the stretcher.

4. The system as defined in claim 2 wherein said bracket structures include a pair of longitudinally extending upstanding brackets at the center side portions of the rigid panel to engage and support an incubator.

5. The system as defined in claim 4 wherein said bracket structures also include a rack system at one end of the panel, said rack system including longitudinally spaced upstanding brackets, an elevated shelf supported from said longitudinally spaced upstanding brackets, upstanding brackets mounted on the elevated shelf, an upper shelf mounted from said upstanding brackets on the elevated shelf, upstanding brackets mounted on and extending upwardly from the upper shelf to form supporting shelves and brackets, said ECG monitor, pulse oximeter, oxygen monitor and infusion pump being supported in a stacked array from said shelves and brackets.

6. The system as defined in claim 5 wherein said bracket structures further include a peripheral frame bracket and upstanding end brackets mounted adjacent the end of the panel remote from the rack system, said alternative AC cord and DC battery system being mounted on said peripheral frame bracket and end brackets, said power switch being mounted on the panel between the peripheral frame bracket and the incubator for supplying AC or DC power on demand.

7. A neonatal transport device comprising a rigid, generally rectangular, horizontal stretcher, handle forming means located peripherally of said stretcher to enable the stretcher to be carried, a plurality of bracket structures mounted on the stretcher, a plurality of medical equipment mounted on said bracket structures in optimum relationship and in secure relationship to the stretcher, said supported medical equipment including an incubator for a neonate mounted centrally of the stretcher, a humidifier supported from the incubator, an infusion pump, oxygen monitor, pulse oximeter and neonatal ECG monitor mounted adjacent one end of the stretcher in generally horizontal alignment with the incubator and an AC cord and DC battery system with power switch adjacent the other end of the stretcher in generally horizontal alignment with the incubator for supplying AC or DC power on demand to the medical equipment thereby providing a low profile, generally balanced transport device.

* * * * *